US010994810B1

(12) United States Patent
Scheele et al.

(10) Patent No.: US 10,994,810 B1
(45) Date of Patent: May 4, 2021

(54) COLLAPSIBLE RAIL SYSTEMS FOR MARINE VESSELS

(71) Applicant: Brunswick Corporation, Mettawa, IL (US)

(72) Inventors: Kage J. Scheele, Roanoke, IN (US); Jeremy D. Ward, Fort Wayne, IN (US); Kirk W. Harmon, Fort Wayne, IN (US)

(73) Assignee: BRUNSWICK CORPORATION, Mettawa, IL (US)

( * ) Notice: Subject to any disclaimer, the term of this patent is extended or adjusted under 35 U.S.C. 154(b) by 149 days.

(21) Appl. No.: 16/284,054

(22) Filed: Feb. 25, 2019

Related U.S. Application Data

(60) Provisional application No. 62/636,394, filed on Feb. 28, 2018.

(51) Int. Cl.
*B63B 17/04* (2006.01)

(52) U.S. Cl.
CPC ..... *B63B 17/04* (2013.01)

(58) Field of Classification Search
CPC ..... B63B 17/04; B60P 3/34; B60J 5/102
See application file for complete search history.

(56) References Cited

U.S. PATENT DOCUMENTS

| | | | | |
|---|---|---|---|---|
| 6,234,098 | B1 | 5/2001 | Biedenweg et al. | |
| 6,443,088 | B1 | 9/2002 | Putman et al. | |
| 6,715,440 | B2 | 4/2004 | Biedenweg et al. | |
| 8,943,995 | B2 * | 2/2015 | Muller | B63B 27/14 114/362 |
| 9,067,646 | B2 * | 6/2015 | Admire | B63B 35/34 |
| 9,957,016 | B2 * | 5/2018 | Grimaldi | B63B 23/48 |
| 2018/0099726 | A1 * | 4/2018 | Broadway | B63B 3/48 |
| 2019/0217922 | A1 * | 7/2019 | Allender | B63B 19/00 |

FOREIGN PATENT DOCUMENTS

| | | | | |
|---|---|---|---|---|
| DE | 3038893 A | * | 4/1982 | B63B 17/04 |

* cited by examiner

*Primary Examiner* — Andrew Polay
(74) *Attorney, Agent, or Firm* — Andrus Intellectual Property Law, LLP

(57) ABSTRACT

A rail system for a marine vessel having an upper deck. The rail system has a set of forward rails that encloses a portion of the upper deck, where the set of forward rails includes a front rail and folding side rails. The set of forward rails is pivotable between an up position and a down position. A plurality of floor hinges pivotally couple the folding side rails to the upper deck. The set of forward rails has an up height when in the up position and a down height when in the down position that is lower than the up height.

20 Claims, 13 Drawing Sheets

COLLAPSIBLE RAIL SYSTEMS FOR MARINE VESSELS

CROSS REFERENCE TO RELATED APPLICATIONS

This application claims the benefit of U.S. Provisional Patent Application No. 62/636,394, filed Feb. 28, 2018, which is incorporated herein by reference in its entirety.

FIELD

The present disclosure generally relates to rail systems for marine vessels, and more particularly to collapsible rail systems for marine vessels.

BACKGROUND

The Background and Summary are provided to introduce a foundation and selection of concepts that are further described below in the Detailed Description. The Background and Summary are not intended to identify key or essential features of the claimed subject matter, nor are they intended to be used as an aid in limiting the scope of the claimed subject matter.

The following U.S. Patents and Patent Applications are incorporated herein by reference:

U.S. Pat. No. 6,715,440 discloses a collapsible changing room for a pontoon boat having a rear entry stern gate. The collapsible changing room is formed in part by the passenger seat positioned adjacent the rear entry stem gate. An L-shaped bracket is rigidly secured to the rear portion of the seat and is further hingedly secured to a vertical fence member spaced from the seat back. The seat and the L-shaped support can be rotated upwardly away from the boat deck to a position in which the seat bottom is generally perpendicular to the boat deck. When the seat is rotated to this position, a curtain frame hingedly connected to the seat can be rotated from a stored position within the seat base to an extended position substantially parallel to the boat deck. An opaque sheet or curtain depends from the curtain frame in a substantially vertical orientation to form an enclosed changing or privacy room. Generally, the curtain will include an opening having a closing mechanism such as a zipper to allow entry into the region partitioned by the curtain.

U.S. Pat. No. 6,443,088 discloses a gate assembly for a pontoon boat. The pontoon boat includes a platform deck atop a flotation device with a protective railing having fence sections and gate assemblies at least partially surrounding the deck. The gate assembly is disposed in a gap or opening in the protective fence between two of the fence sections and includes a gate, a gate stop, and a sliding hinge. The gate is attached by the hinge to one of the two fence sections at the opening of the protective railing, and the stop is attached to the other of the two fence sections and includes a stop member extending from the deck to near the top of the fence that will prevent the gate from swinging outwardly. The stop member includes a padding strip thereon between the stop member and the gate, which prevents rattling between the stop member and the gate.

U.S. Pat. No. 6,234,098 discloses a pontoon boat having a flotation device, a deck, and a pair of side rails. The flotation device includes at least two pontoons and a support frame extending between the pontoons and having a pair of side edges. The deck is disposed atop the flotation device and has a top surface and a pair of side edges. The side rail has a generally angled shape and comprises a generally horizontal leg and a generally vertical leg. A free edge of the horizontal leg overlies a portion of the deck proximal a deck side edge. The vertical second leg depends over the support frame side edge. The horizontal leg substantially, horizontally extends the deck. The rails include aligned inboard channels. Adjacent rails connect to one another by means of a plate or other member disposed in and attached to the inboard channel at the terminal ends of two adjoining rails providing for a non-overlapping joint.

SUMMARY

One embodiment of the present disclosure generally relates to a rail system for a marine vessel having an upper deck. The rail system has a set of forward rails that encloses a portion of the upper deck, where the set of forward rails includes a front rail and folding side rails. The set of forward rails is pivotable between an up position and a down position. A plurality of floor hinges pivotally couple the folding side rails to the upper deck. The set of forward rails has an up height when in the up position and a down height when in the down position that is lower than the up height.

Another embodiment generally relates to a rail system for a marine vessel having an upper deck. The rail system has a set of forward rails that encloses a portion of the upper deck, where the set of forward rails includes a front rail, folding side rails, and intermediate rails each coupled between the front rail and one of the folding side rails. The set of forward rails is pivotable between an up position and a down position. A plurality of floor hinges pivotally couple the folding side rails to the upper deck. An actuator is coupled between the front rail and the upper deck, where the actuator is moveable between a retracted position and an extended position to pivot the set of forward rails between the up position and the down position, respectively. A stationary rail extends upwardly and non-pivotally from the upper deck. A lock system has a lock bolt and a lock bolt receiver configured to receive the lock bolt therein. The lock system is coupled between one of the folding side rails and the stationary rail such that when the lock bolt is received within the lock bolt receiver the one of the folding side rails is locked to the stationary rail. In the up position, the folding side rails are perpendicular to the upper deck. In the down position, the folding side rails rest on the upper deck, the intermediate rails rest on the folding side rails, and the front rail rests on the intermediate rails.

Another embodiment generally relates to a rail system for a marine vessel having an upper deck. The rail system includes a set of forward rails that encloses a portion of the upper deck, where the set of forward rails includes a front rail, folding side rails, and intermediate rails each coupled between the front rail and one of the folding side rails. The set of forward rails is pivotable between an up position and a down position. A plurality of floor hinges pivotally couple the folding side rails to the upper deck. An actuator is coupled between the front rail and the upper deck, where the actuator is moveable between a retracted position and an extended position to pivot the set of forward rails between the up position and the down position, respectively. A stationary rail extends upwardly and non-pivotally from the upper deck. A lock system has a lock bolt and a lock bolt receiver configured to receive the lock bolt therein. The lock system is coupled between one of the folding side rails and the stationary rail such that when the lock bolt is received within the lock bolt receiver, the one of the folding side rails is locked to the stationary rail. A back rail has a back up position and a back down position. The back rail has a lower portion that extends upwardly and non-pivotally from the upper deck and also an upper portion pivotally coupled to the lower portion. In the back down position, the upper portion rests on the upper deck. In the back up position, the upper portion rests atop the lower portion. In the up position, the folding side rails are perpendicular to the upper deck. In the down position, the folding side rails rest on the upper deck, the intermediate rails rest on the folding side rails, and the front rail rests on the intermediate rails.

Various other features, objects and advantages of the disclosure will be made apparent from the following description taken together with the drawings.

BRIEF DESCRIPTION OF THE DRAWINGS

The drawings illustrate examples of carrying out the disclosure. The same numbers are used throughout the drawings to reference like features and like components. In the drawings.

DETAILED DISCLOSURE

Marine vessels are a well recognized way to enjoy leisure time on the water either alone, or with a group of family and friends. In certain circumstances, particularly those within the rental or tourism industry, marine vessels are further outfitted with an upper deck to increase the occupancy capacity of the marine vessel, as well as to provide a higher vantage point of the water and surrounding scenery when underway. As with the standard lower deck, an upper deck is customarily outfitted with a railing system to ensure the safety of passengers and equipment both when the marine vessel is stationary, and underway. According to industry standards, including those of the National Marine Manufacturers Association (NMMA), such railings must be a minimum of 34 inches in height to provide this safety.

However, the present inventors have identified that, particularly for rails provided with the upper decks of marine vessels, this required height of at least 34 inches presents a challenge. In particular, the additional height prevents many such marine vessels from fitting within a typical boathouse or other storage facility, requiring an unusually-high clearance. Accordingly, the present inventors have developed the following collapsible rail systems and methods for manufacturing collapsible rail systems that offer a shorter overall height when the rails are collapsed, thereby allowing the marine vessel to fit into a greater number of boathouses and storage facilities.

Figure 1:
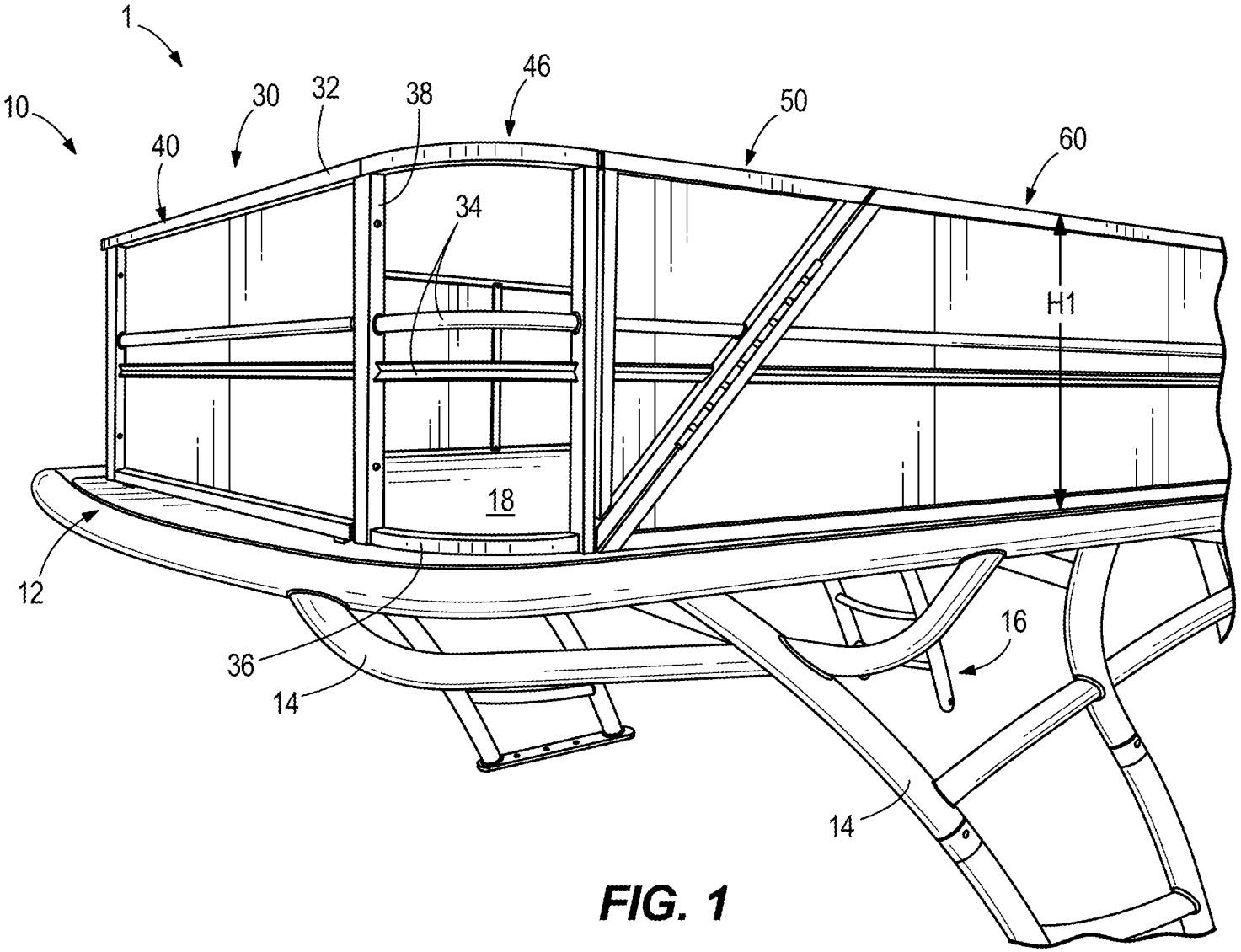
FIGS. 1-2 are isometric front views of one embodiment of a collapsible rail system according to the present disclosure shown in the up and down positions.

FIG. 1 depicts a portion of one such marine vessel 10 that is outfitted with a collapsible rail system 1 in accordance with the present disclosure. FIG. 1 particularly depicts the upper deck 12 of the marine vessel 10, which is configured to be installed on a marine vessel 10 in the customary manner. The upper deck 12 includes a support structure 14, which is shown as a substantially tubular, metallic frame. The support structure 14 further includes steps 16 towards the rear, providing access for users to move between the lower deck (not shown) and upper deck 12 of the marine vessel 10. The upper deck 12 further includes a floor 18, which may be covered with marine-grade carpeting, for example.

Figure 2:
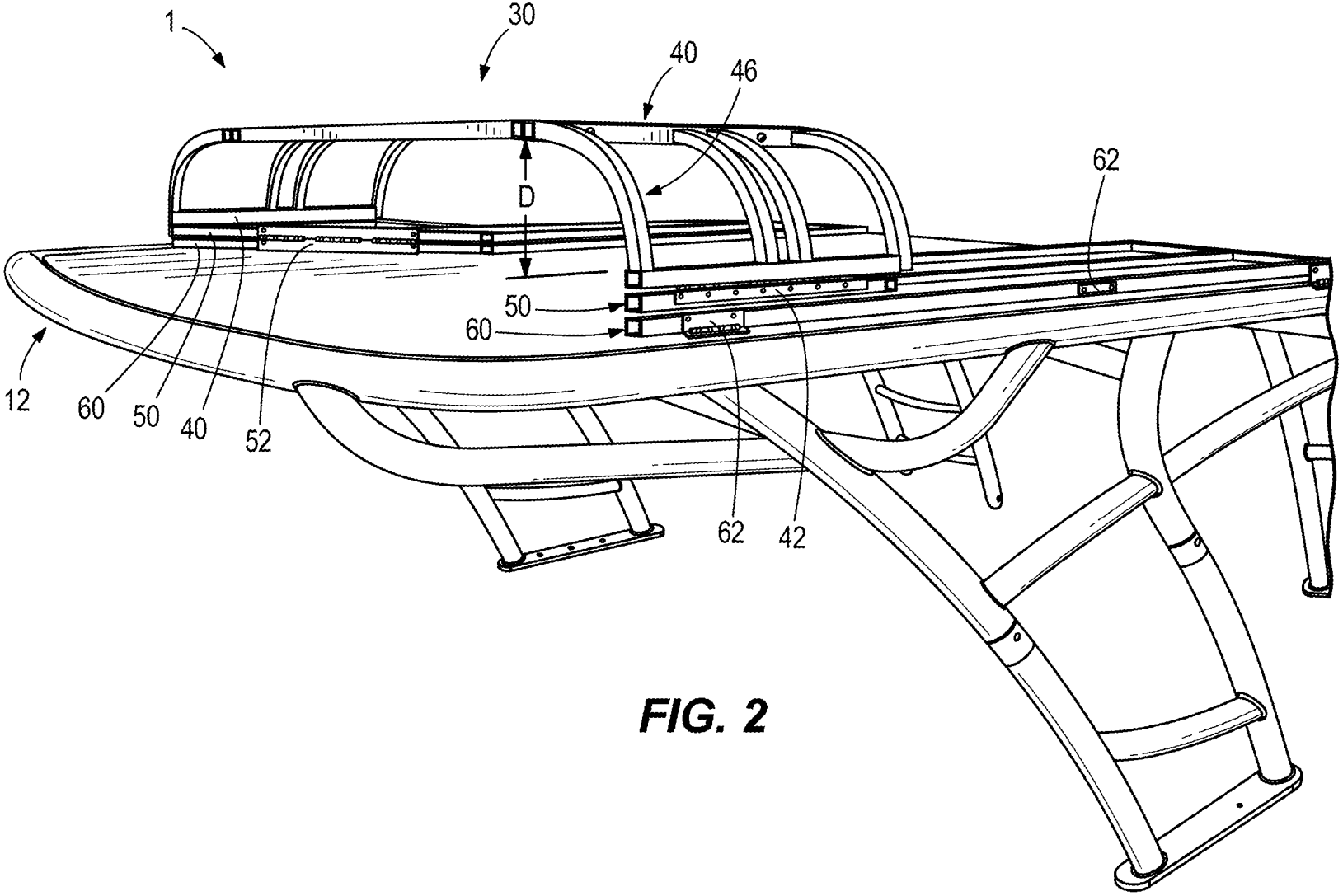

The collapsible rail system 1 of FIG. 1 is shown in the up position, which is lockable to provide safety and security of passengers in the upper deck 12. The forward rails 30 of the collapsible rail system 1 have a height H1 meeting the minimum requirement of at least 34 inches when locked in the up position. In the example shown, the forward rails 30 are made of a 1⅛ inch squared aluminum. In contrast, FIG. 2 depicts the collapsible rail system 1 from FIG. 1 in a down position in which it has collapsed into a shorter profile, or storage state. Beyond the thicknesses of these rails, the overall height of the collapsible rail system 1 in the down position is principally defined by the depth D of the front rail 40 and corner pieces 46.

Figure 3:
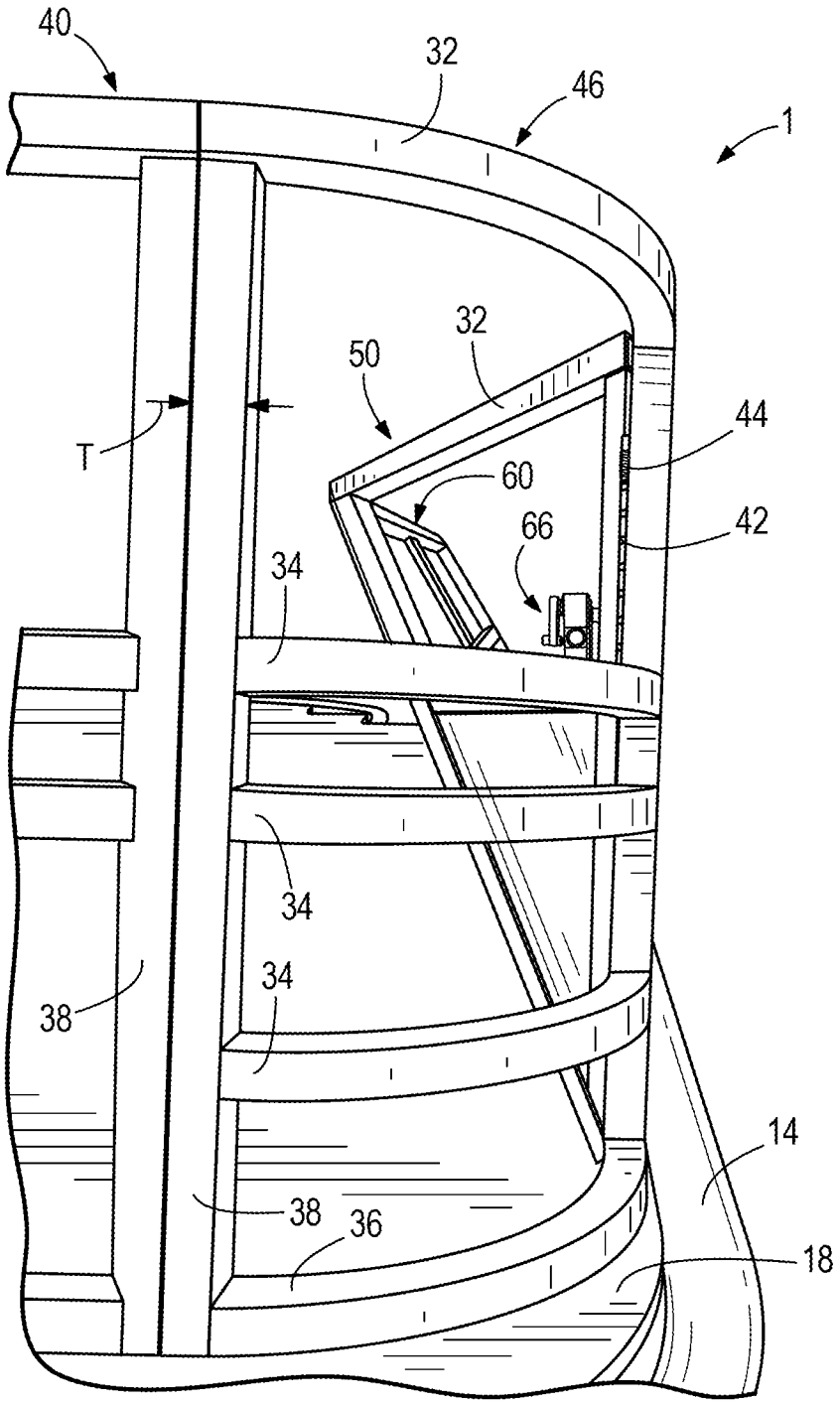
FIGS. 3-4 depict front and isometric back views of the collapsible rail system of FIGS. 1-2 in a partially-up position.
Figure 8:
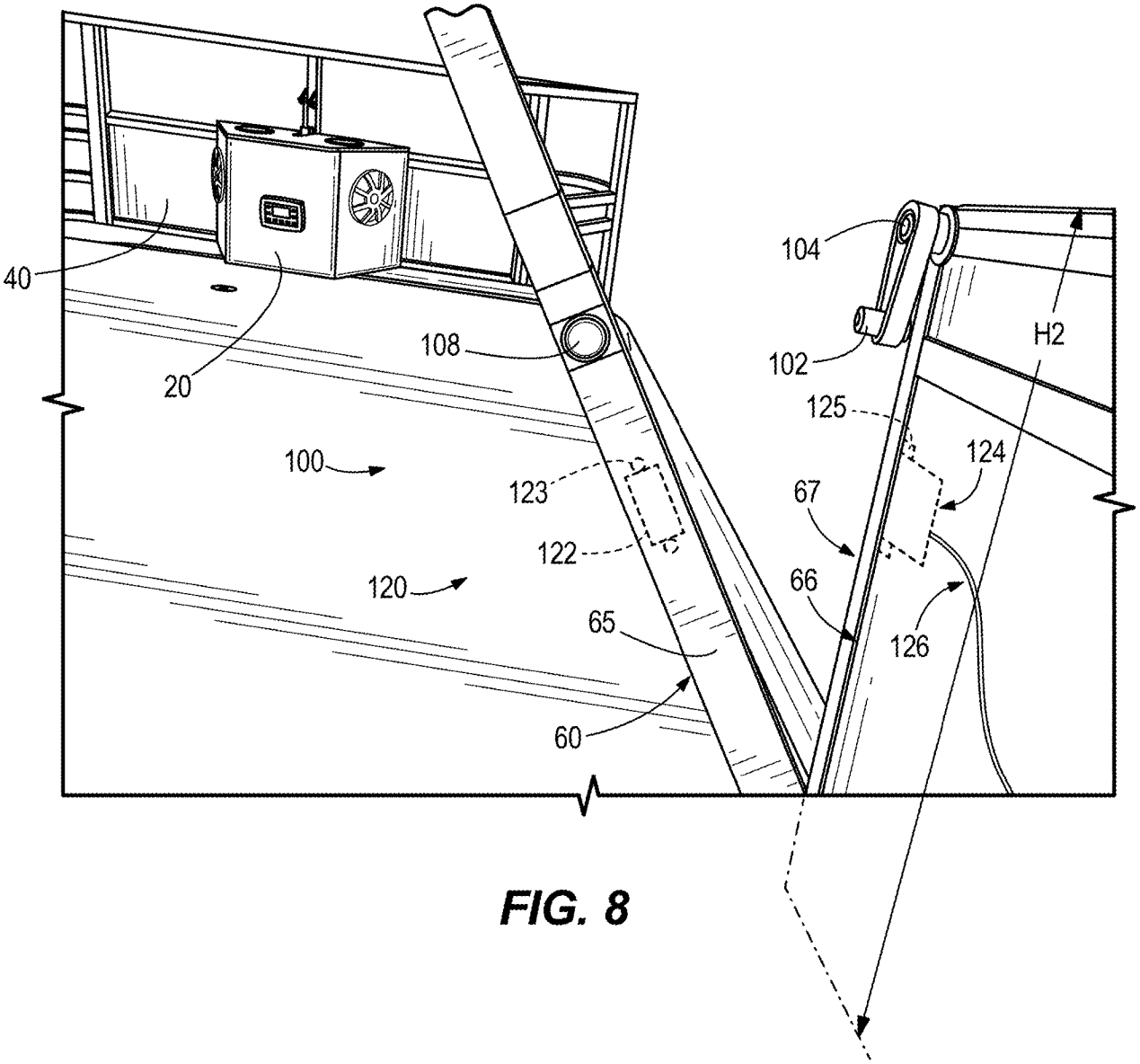
FIGS. 8-9 depict back and front views showing a forward lock system incorporated in a collapsible rail system similar to that shown in FIGS. 3-4 in a partially-up position.
Figure 9:
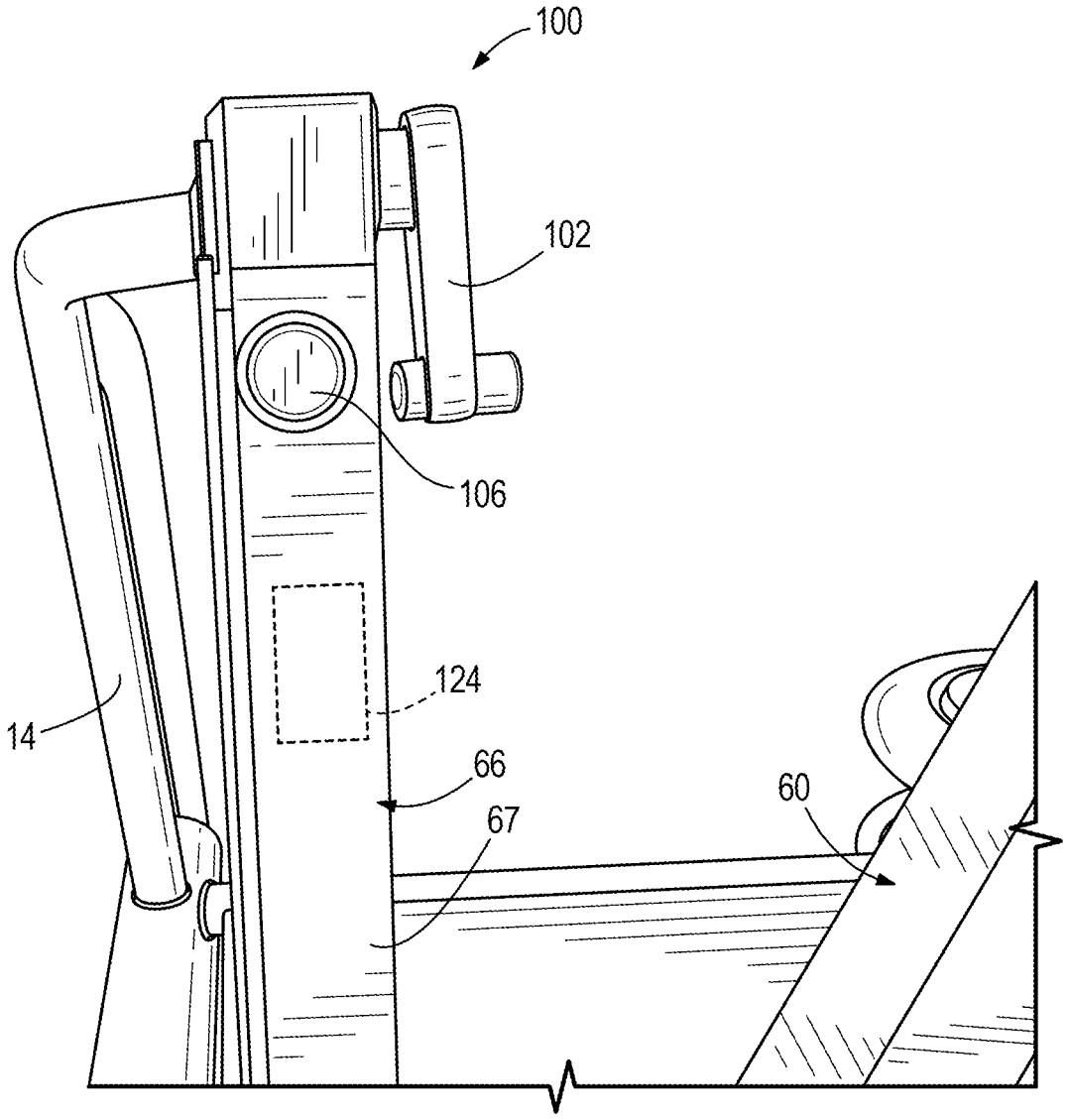
Figure 10:
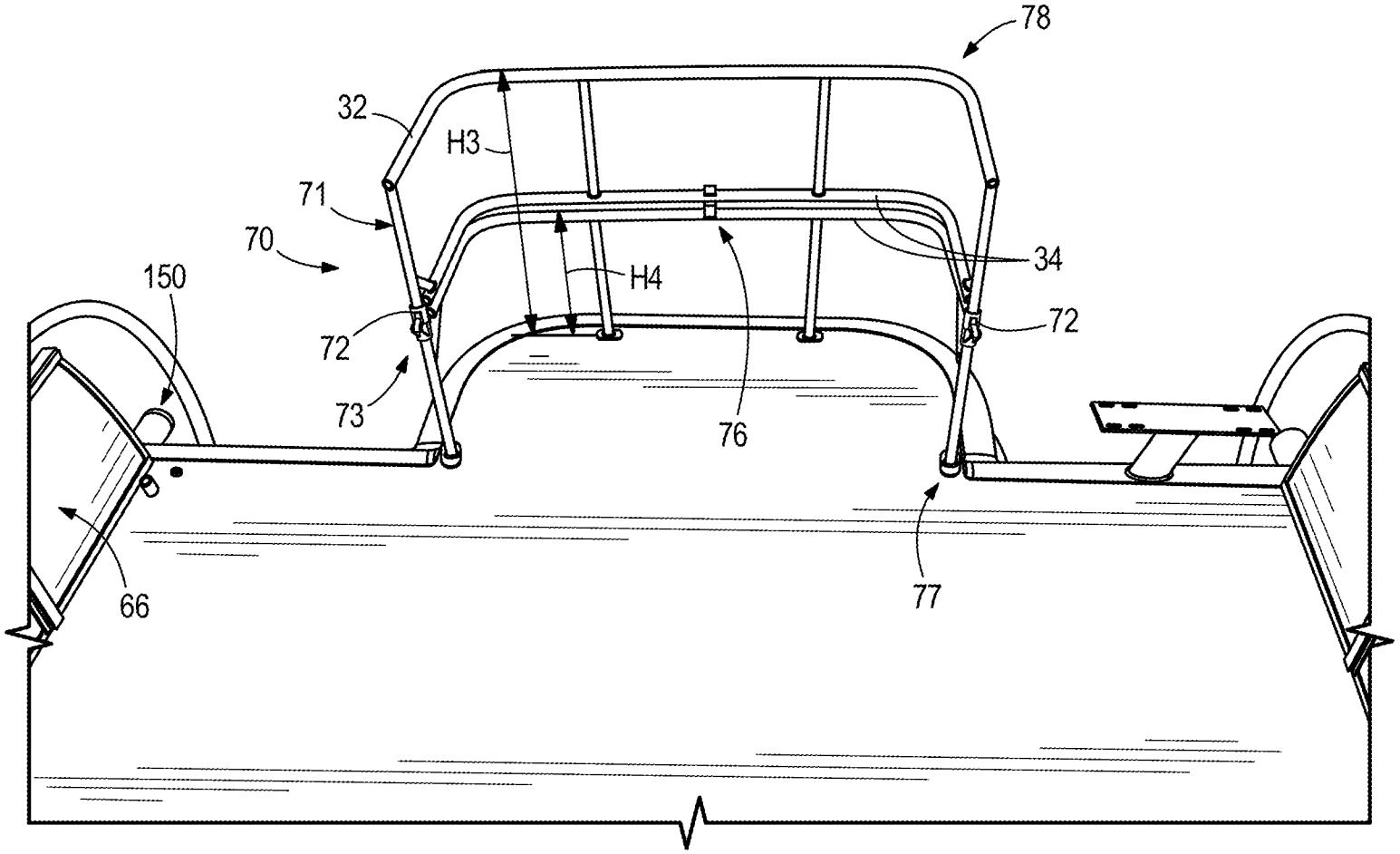
FIG. 10 is a front view of a back rail system according to the present disclosure in an up position.

As shown in FIGS. 1-3, the forward rails 30 include a front rail 40, corner pieces 46, intermediate rails 50, folding side rails 60, and stationary side rails 66 (which are shown in FIGS. 8-10). These forward rails 30 comprise a top rail 32, one or more middle supports 34, a bottom support 36, and a series of vertical supports 38.

As shown in FIGS. 2-4 and 6, the front rail 40 is coupled to each of the intermediate rails 50 by a front-intermediate hinge 42, which is presently shown as a piano-style hinge. Likewise, each of the intermediate rails 50 is coupled to one of the folding side rails 60 by an intermediate-side hinge 52, which is also shown to be a piano-style hinge. Each folding side rail 60 is also pivotally coupled to the floor 18 of the upper deck 12 by a series of side-floor hinges 62. In this manner, the folding side rails 60 are configured to fold inwardly to rest upon the floor 18. Concurrently, the intermediate rails 50 become nested between the front rail 40 and the folding side rails 60 when the collapsible rail system 1 is in the down position (see FIG. 2). This folding is by virtue of the intermediate rail 50 having a substantially-triangular shape with the intermediate-side hinges 52 having a hinge axis that is oriented at approximately a 45 degree angle relative to the hinge axes of both the front-intermediate hinges 42 and the side-floor hinges 62 when viewed from the side, in the up position.

Figure 4:
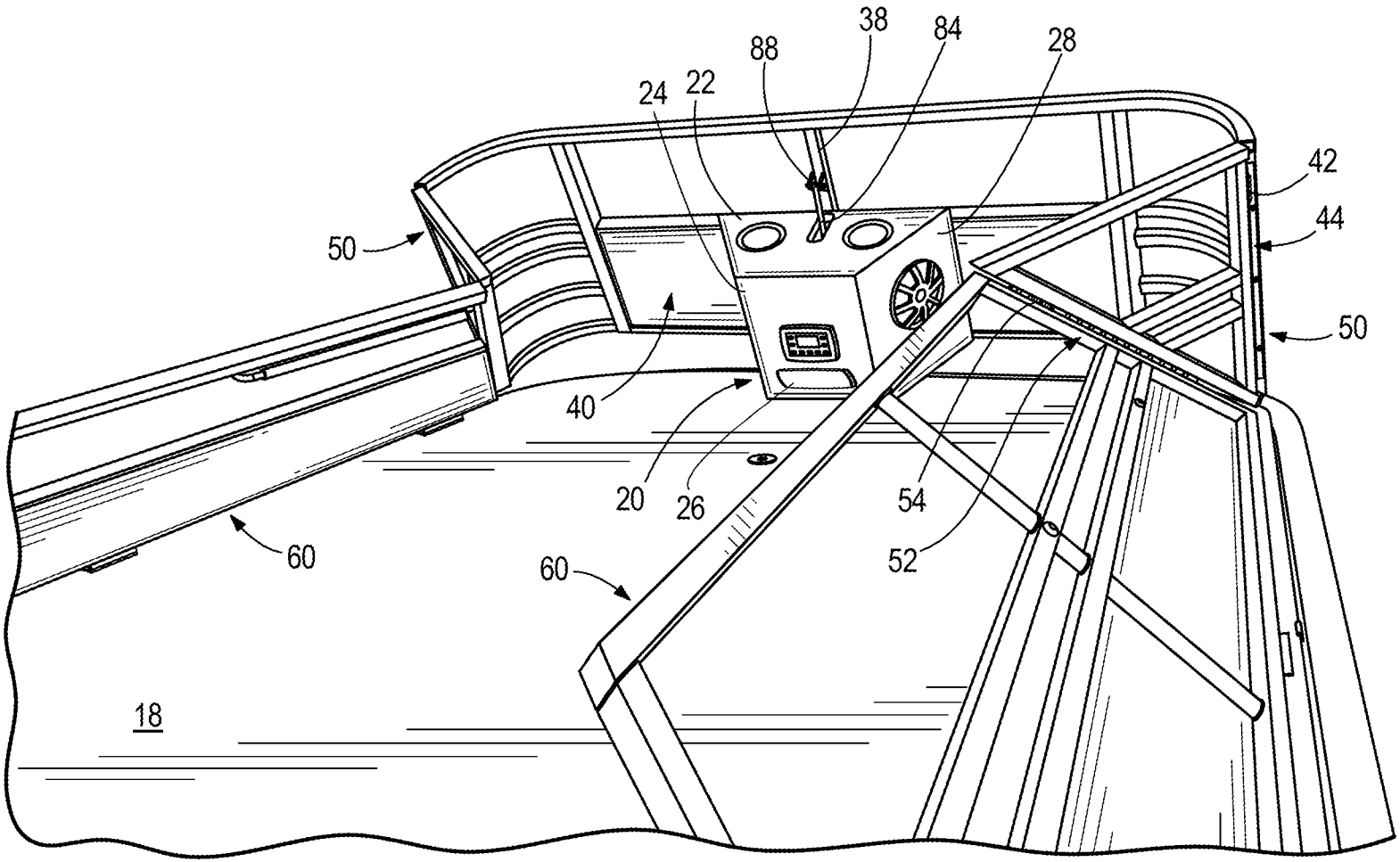

FIGS. 3 and 4 depict the collapsible rail system 1 shown in FIGS. 1 and 2 in a partially-up position. As shown, the folding side rails 60 are tipped partially inwardly, as are the intermediate rails 50. This causes the bottom support 36 of the front rail 40 to begin lifting upwardly off of the floor 18 via the hinged connection between the front rail 40 and folding side rails 60. FIG. 4 further shows the front-intermediate hinge 42 and the intermediate-side hinge 52 coupling the front rail 40 to the intermediate rail 50, and the intermediate rail 50 to the folding side rail 60, respectively. As exemplified by the intermediate-side hinge 52, at least some of the hinges bias the collapsible rail system 1 towards the down position. In particular, the intermediate-side hinge 52 shown has a biasing spring 54 that biases the collapsible rail system 1 towards the down position. These biasing springs 54 assist the actuator 80 (FIG. 7, discussed below) in lowering the collapsible rail system 1, and also in maintaining this lower position when the marine vessel 10 is not in use. The collapsible rail system 1 is maintained in the up position against this bias by a forward lock 100, which is discussed further below.

Figure 5:
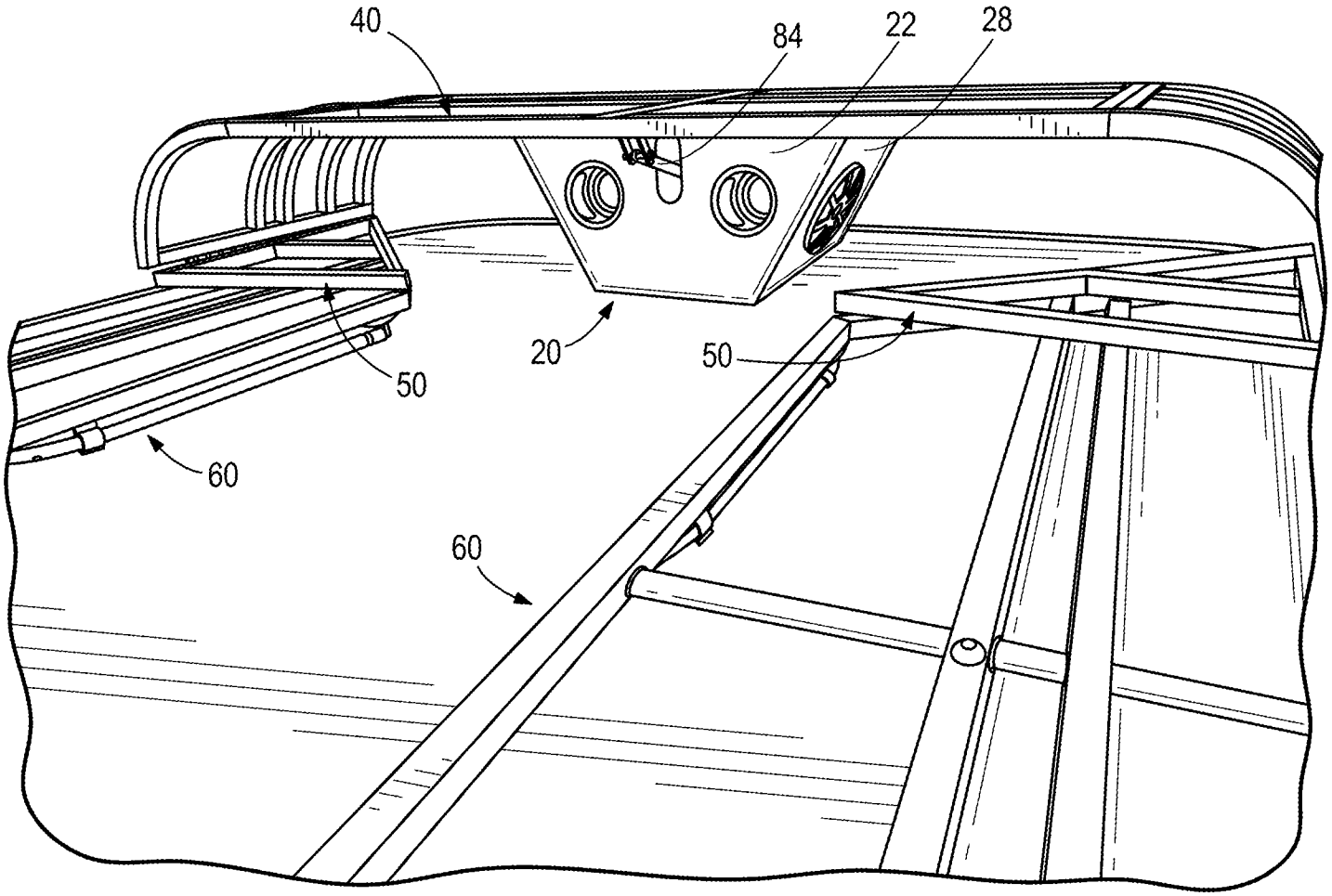
FIG. 5 is an isometric back view of a collapsible rail system such as that shown in FIGS. 1-2 in the down position.
Figure 6:
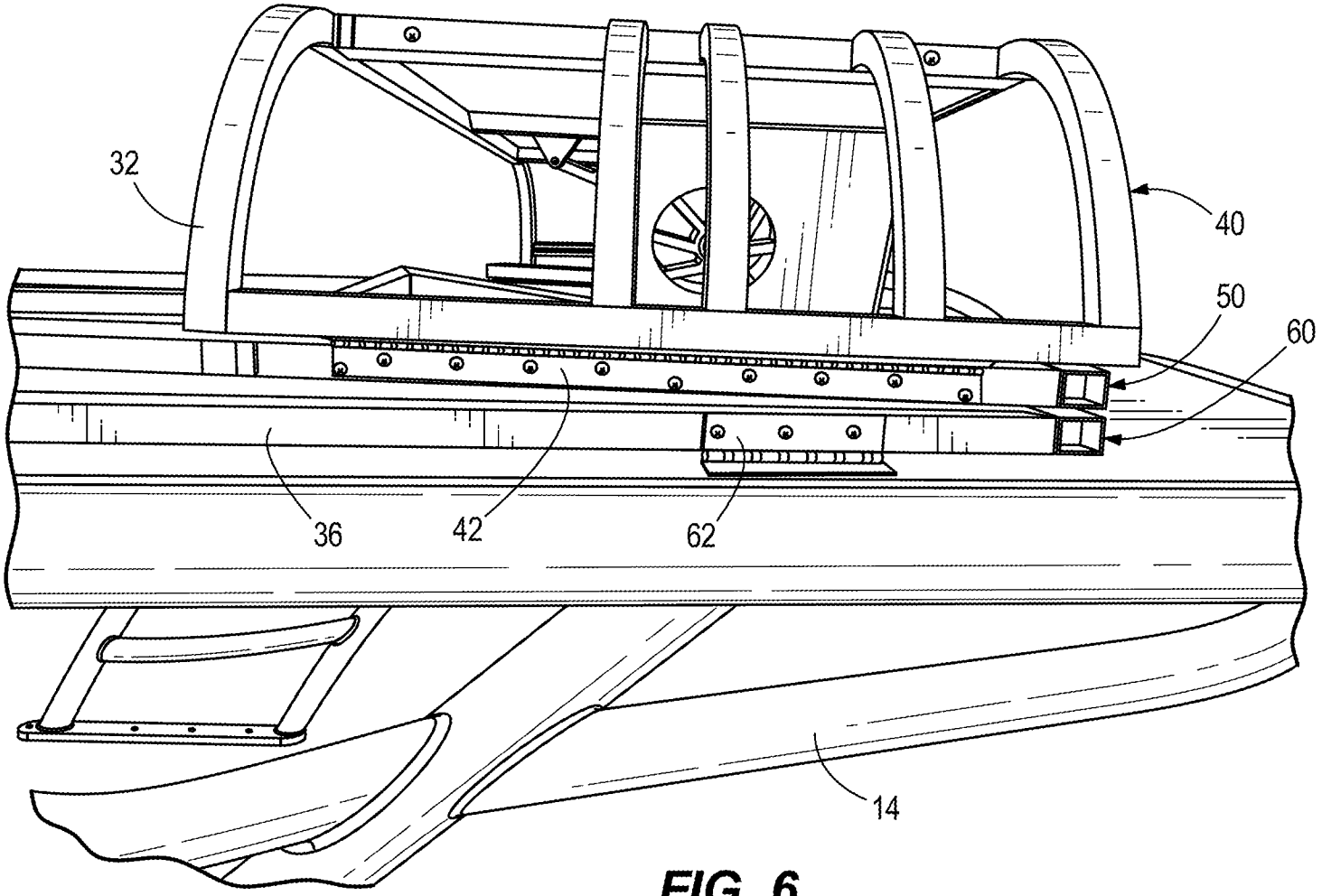
FIGS. 6-7 are side and front views of the collapsible rail system from FIG. 5 in the down position.

As shown in FIGS. 4-5, a front console 20 is coupled to the front rail 40, which may include an audio system, cup holders, and the like. The front console 20 also pivots when the collapsible rail system 1 is moved towards the down position. The front console 20 has a top 22, a bottom 23 (FIG. 7), side facing walls 28, and a rear-facing wall 24 with a bumper 26. The bumper 26 provides support for the front console 20 when rotated to the down position, also providing an offset such that any accessories mounted to the rear-facing wall 24 of the front console 20 (shown as a radio) do not make direct contact with the floor 18, and are thereby protected.

Figure 7:
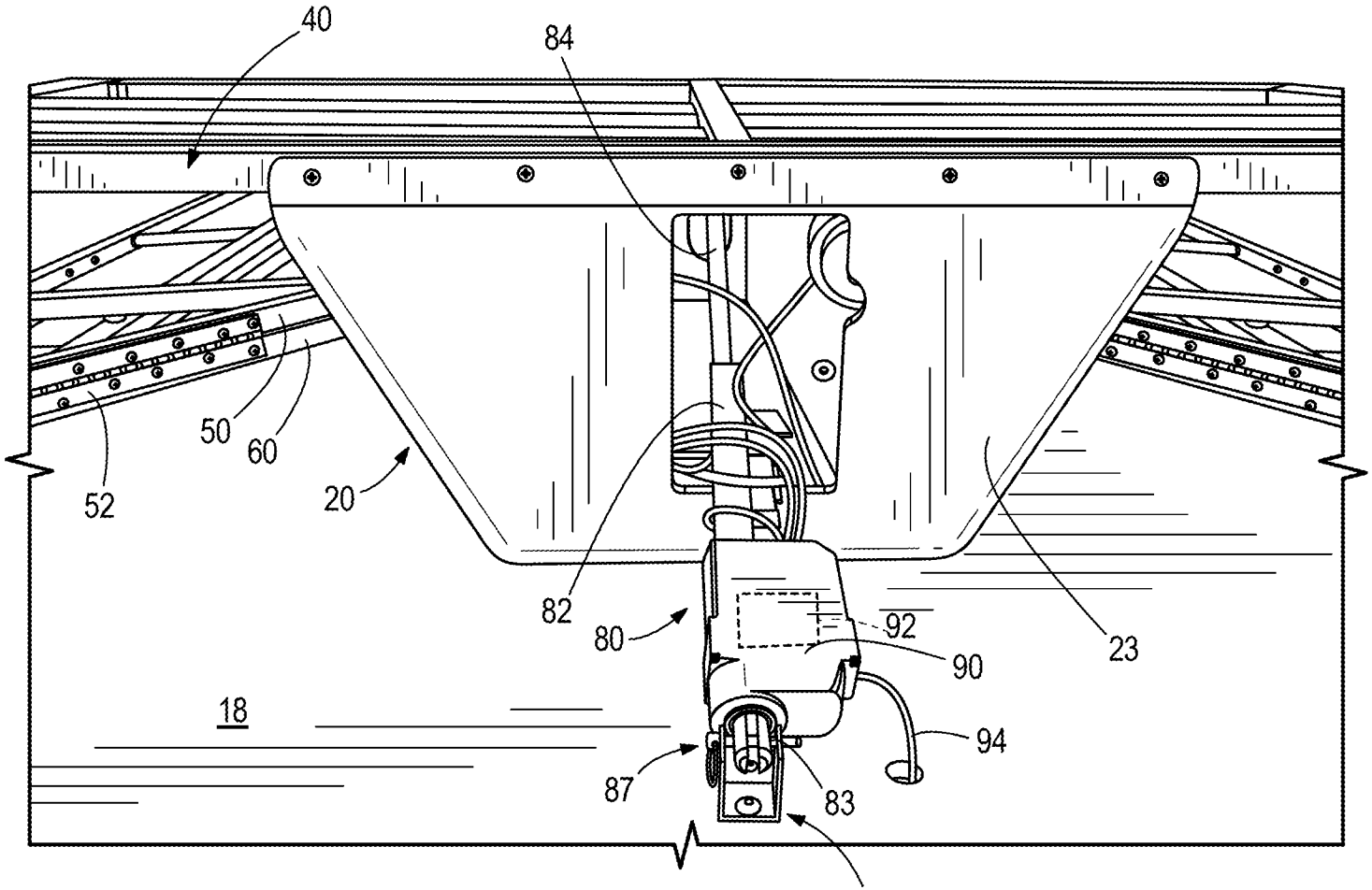

FIG. 7 shows an exemplary actuator 80 for transitioning the collapsible rail system 1 between the up position and down position. In particular, the actuator 80 has a stationary portion 82, a movable rod 84, and an actuator driver 90. The stationary portion 82 has a mount opening 83 that is coupled with a floor mount coupler 87 to a floor mount 86 attached to the floor 18 of the upper deck 12. The floor mount coupler 87 is shown as a pin with a locking cotter pin and the floor mount 86 as a bracket, all being commercially available, for example.

Likewise, as shown in FIG. 4, the movable rod 84 is coupled to the front rail 40 via a front rail mount 88 in the manner as described for coupling the stationary portion 82 to the floor 18. The movable rod 84 extends upwardly through the top 22 of the front console 20 to be coupled to the front rail 40 via the front rail mount 88. The front rail mount 88 is positioned substantially near the top rail 32 of the front rail 40. The present inventors have identified through experimentation and development that this placement of the actuator 80, including its mounting to the front rail 40, provides substantial leverage and a mechanically-advantageous orientation for rotating the front rail 40 between the up position and the down position. As shown in FIG. 7, the actuator driver 90, floor mount 86, and wiring harness 94 for the actuator 80 are positioned to be shielded from the elements when the collapsible rail system 1 is in the up position by virtue of being positioned within the front console 20. However, other mounting locations are also possible, including those in which the entire actuator 80 is hidden with the front console 20.

One exemplary actuator 80 for transitioning the collapsible rail system 1 is a polarity reversing actuator linear made by Linak (item no. 2362001200300A6). However, other types of actuators are known in the art. The actuator 80 includes a position encoder 92 for detecting the relative positions of the movable rod 84 and the stationary portion 82. In this respect, the position encoder 92 provides feedback (for example, to a controller module 144 as discussed below) that indicates whether the collapsible rail system 1 is in the fully up position, fully down position, or some intermediate position therebetween.

As shown in FIGS. 8-9, the collapsible rail system 1 further includes a stationary side rail 66 on each side of the marine vessel 10. When the collapsible rail system 1 is in the up position, the stationary side rails 66 are adjacent and in alignment with the folding side rails 60. The stationary side rail 66 has a height H2 that is different than the height H1 of the forward rails 30. In particular, the height H2 of the collapsible rail system 1 shown is such that it need not fold down for the marine vessel 10 to fit the desired boathouse clearance limitations.

FIGS. 8-9 further depict a forward lock 100 configured to lock the forward rails 30 in the up position. As previously described and shown in FIGS. 2-4 and 6, the front-intermediate hinges 42 and intermediate-side hinges 52 contain biasing springs 44 and 54 to bias the forward rails 30 towards the closed position. This biasing provides that the folding side rails 60 are not aligned with the corresponding stationary side rail 66 unless the forward lock 100 is engaged.

The forward lock 100 has a forward lock handle 102 that rotates about an axle 104 mounted to the stationary side rail 66. Rotation of the forward lock handle 102 causes the forward lock bolt 106 to extend and retract from the front facing edge 67 of the stationary side rail 66 in a similar manner to a household deadbolt as known in the art. This forward lock bolt 106 is receivable within a forward lock receiver 108 within the rear facing edge 65 of the folding side rail 60. An independent forward lock 100 is provided for each side of the marine vessel 10 such that each of the folding side rails 60 can be locked, relative to the corresponding stationary side rails 66, in the up position.

FIGS. 8-9 further depict an exemplary proximity sensor 120 known in the art, which as shown is a magnetic switch made by Carling Technologies (model 1712 R). In particular, the proximity sensor 120 has a detector component 124 that is mountable by a mounting system 125, as well as a detectable component 122 (shown here to be a magnet) that is mountable with a mounting system 123. A wiring harness 126 electronically couples the proximity sensor 120 to the control system 140.

The proximity sensors 120 is positioned at the interfaces between the stationary side rails 66 and the folding side rails 60, which detect whether the forward rails 30 are in the fully up position. The detector component 124 is mounted via the mounting system 125 to the front facing edge 67 of the stationary side rail 66, which may be embedded within the stationary side rail 66. Likewise, the detectable component 122 is mounted by the mounting system 123 within the rear facing edge 65 of the folding side rail 60. The port and starboard sides of the marine vessel 10 are each outfitted with an independent proximity sensor 120 to detect whether the entirety of the forward rails 30 is positioned and locked in the fully up position.

Specifically, when the forward locks 100 are engaged, the detector component 124 detects the alignment to the detectable component 122, indicating that the respective folding side rails 60 are in the up position and locked. In other examples, additional sensors are provided to determine whether the collapsible rail system 1 is in the fully down position. In further exemplary collapsible rail systems 1, engine operations are limited unless the collapsible rails system 1 is fully up or fully down, which is discussed further below.

As will also be discussed further below, the present embodiment has a control system 140 that controls operation of the actuator 80. When the proximity sensors 120 detect that the collapsible rail system 1 is in the fully up position, the proximity sensors 120 provide a signal to the control system 140 to stop moving the actuator 80 in the up direction. In embodiments having proximity sensors for the down position, signals are likewise sent to stop moving the forward rails 30 towards the down position. In other words, once the proximity sensors 120 or other sensors indicate that the collapsible rail system 1 is fully up or down, the control system 140 is configured to stop the actuator 80 from moving. This prevents damage to the actuator 80, forward rails 30, floor 18, and other electronic and mechanical components. As previously discussed, the inputs from the proximity sensor 120 may be complimentary or redundant with some of the signals provided by a position encoder 92 within the actuator 80, depending on the particular actuator 80 and proximity sensor 120 used.

Figure 13:
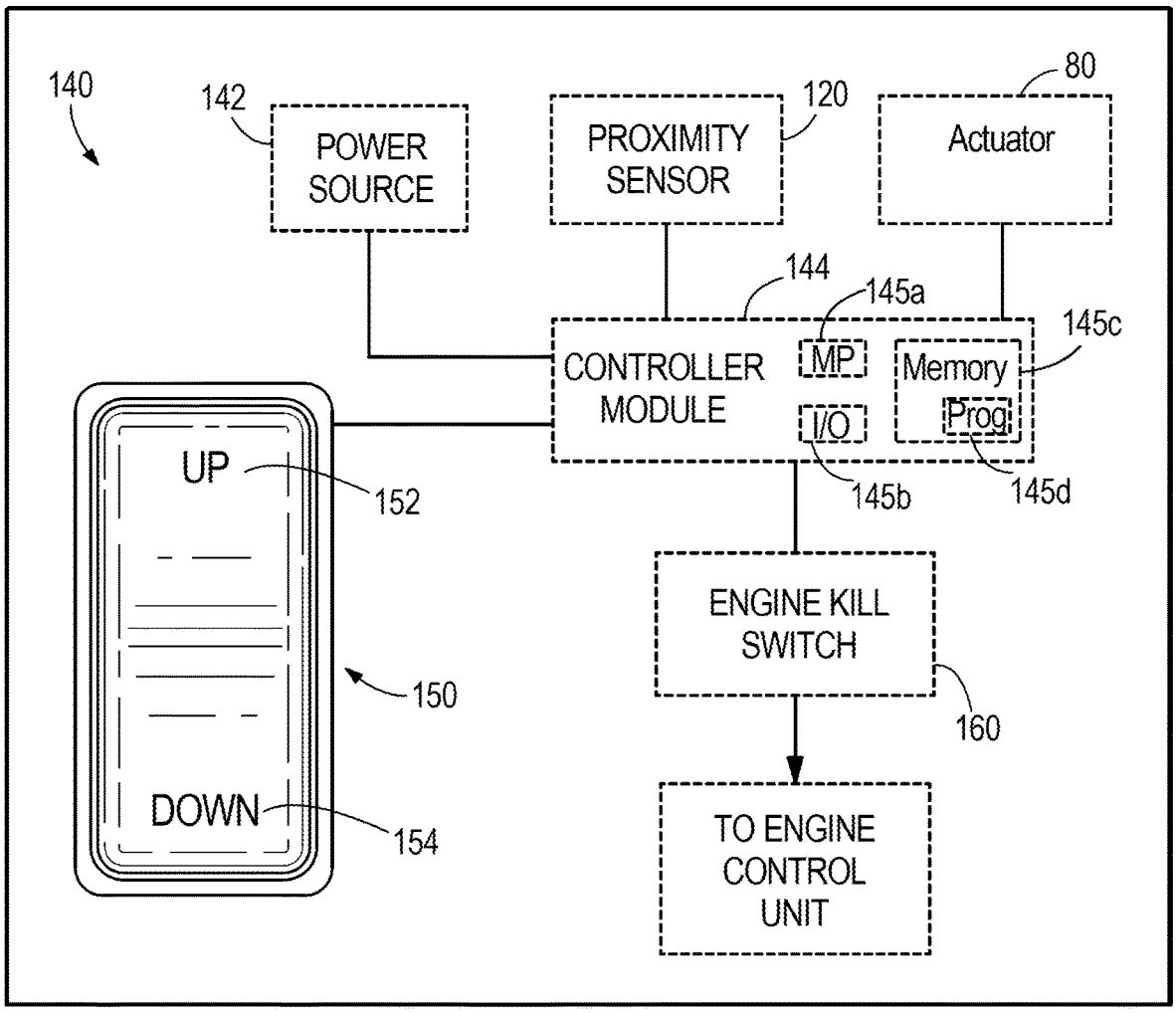
FIG. 13 is a schematic view of an exemplary control system for operating the collapsible rail system according to the present disclosure.

FIG. 13 depicts one embodiment of a control system 140 for controlling the actuator 80, as well as related electronic devices to be discussed below. Certain aspects of the present disclosure are described and depicted, including within FIG. 13, in terms of functional and/or logical block components and various processing steps. It should be recognized that any such functional and/or block components and processing steps may be realized by any number of hardware, software, and/or firmware components configured to perform the specified functions. For example, certain embodiments employ various integrated circuit components, such as memory elements, digital signal processing elements, logic elements, look-up tables, or the like, which are configured to carry out a variety of functions under the control of one or more processors or other control devices. The connections between functional and logical block components are also merely exemplary. Moreover, the present disclosure anticipates communication among and between such components being wired, wireless, and through different pathways.

These functions may also include the use of computer programs that include processor-executable instructions, which may be stored on a non-transitory tangible computer readable medium. The computer programs may also include stored data. Non-limiting examples of the non-transitory tangible computer readable medium are nonvolatile memory, magnetic storage, and optical storage. As used herein, the term module may refer to, be part of, or include an application-specific integrated circuit (ASIC), an electronic circuit, a combinational logic circuit, a field programmable gate array (FPGA), a processor system (shared, dedicated, or group) that executes code, or other suitable components that provide the described functionality, or a combination of some or all of the above, such as in a system-on-chip. The term module may include memory (shared, dedicated, or group) that stores code executed by the processor. The term code, as used herein, may include software, firmware, and/or microcode, and may refer to programs, routines, functions, classes, and/or objects. The term shared, as used above, means that some or all code from multiple modules may be executed using a single (shared) processor. In addition, some or all code to be executed by multiple different processors as a computer system may be stored by a single (shared) memory. The term group, as used above, means that some or all code comprising part of a single module may be executed using a group of processors. Likewise, some or all code comprising a single module may be stored using a group of memories as a memory system.

Furthermore, certain elements are shown as singular devices for the sake of clarity, but may be combined or subdivided differently to perform the same function. For example, the microprocessor 145*a* shown may represent a group of microprocessors 145*a* functioning as a system.

The control system 140 shown in FIG. 13 further includes an actuation switch 150 for controlling the actuator 80 to position the collapsible rail system 1 in the up position, or the down position. The actuator switch 150 shown is provided with an up button 152 and a down button 154, corresponding to movement towards these position for the forward rails 30. In certain embodiments, actuation switch 150 is a manual, momentary switch. In other embodiments, the actuation switch 150 is connected to a controller module 144 to provide automatic movement to the fully up position or the fully down position. In this case, pressing either the up button 152 or the down button 154 once causes the forward rails 30 to move entirely to the up or down position, respectively.

The controller module 144 includes a microprocessor (MP) 145*a* operatively coupled to an input/output module (I/O) 145*b* and a memory module 145*c* storing an executable program 145*d*. The program 145*d* is executable by the microprocessor 145*a* and provides the logical instructions for operating the actuator 80 and collapsible rail system 1 more generally, including the safety parameters discussed below.

The controller module 144 may further incorporate input (via the input/output module 145*b*) from the position encoder 92 within the actuator 80, proximity sensors 120, and/or from other sensors or devices for sensing and controlling the collapsible rail system 1. In certain embodiments, the controller module 144 is further connected to a proximity sensor 120 that senses whether the forward rails 30 are fully in the up position. In further embodiments, the controller module 144 communicates with an engine kill switch 160 such that when the proximity sensor 120 and/or other sensors indicate that the forward rails 30 are not either in the fully up or the fully down position, the engine kill switch 160 prevents the marine vessel's engine from operating, and/or from being placed in gear. This protects passengers from injury that could occur by being on the upper deck 12 without the collapsible rail system 1 being locked in the fully up position. These systems also prevent damage to the collapsible rail system 1 that could be caused by operating the marine vessel 10 when the collapsible rail system 1 is not in a stable position, either fully up or fully down. FIG. 13 further depicts one exemplary connection to a power source 142, which may be to the controller module 144, to the actuator 80 directly, or provided by some other pathway to power the actuator 80 and/or control system 140.

Figure 12:
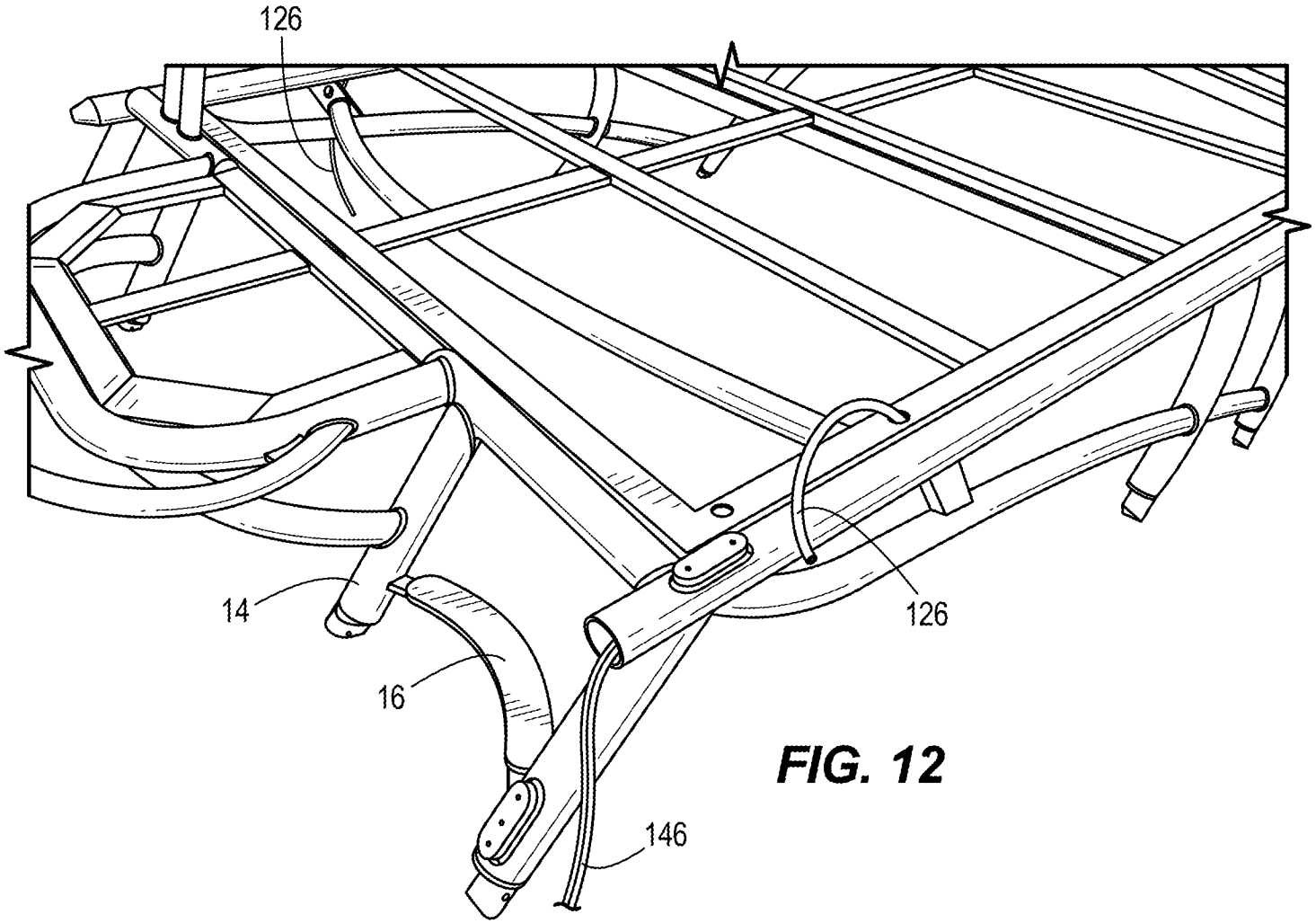
FIG. 12 depicts an embodiment of a routing pathway for wire harnesses for a collapsible rail system according to the present disclosure.

FIG. 12 demonstrates that the various wiring harnesses connected to the actuator 80 and other components of the control system 140 may be routed through the tubular structure of the upper deck 12, emanating substantially near where the front console 20 or other components are positioned.

Figure 11:
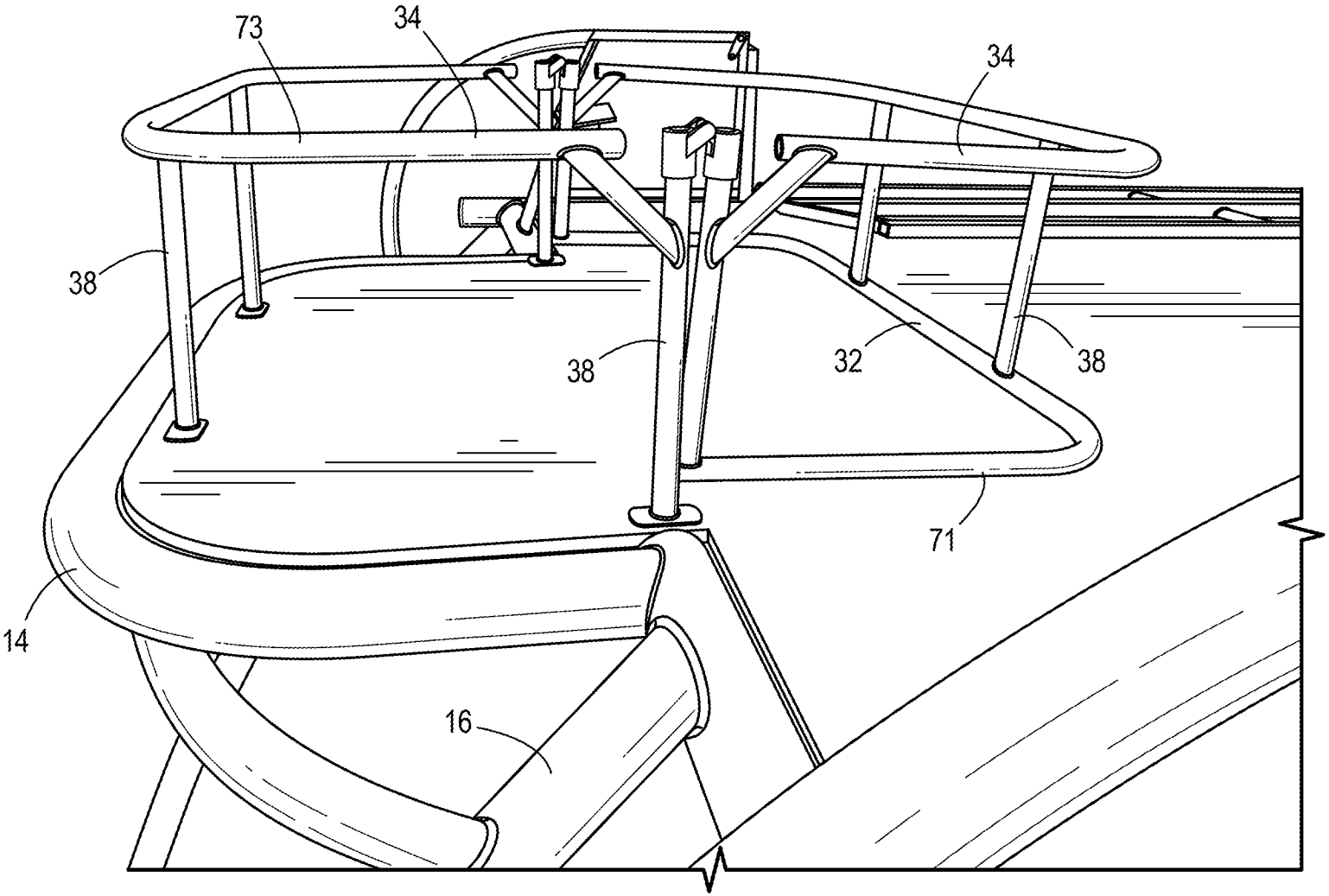
FIG. 11 is a side view of the back rail system of FIG. 10 in a down position.

FIGS. 10-11 show an embodiment of collapsible rail system 1 that further includes a back rail 70 positioned towards the back of the upper deck 12. The back rail 70 includes an upper portion 71 that is pivotably coupled to the lower portion 73 via back hinges 72. The back rail 70 includes a front facing side 77 and a rear facing side 78. The back rail 70 has an upper height H3 when the upper portion 71 is rotated on top of the lower portion 73, and a lower height H4 when the upper portion 71 is rotated downwardly from the lower portion 73. A back lock 76 (FIG. 10) is provided to lock the upper portion 71 on top of the lower portion 73 until unlocked by an operator to permit the back rail 70 to rotate downwardly. The back lock 76 may be of the type used as a gate lock, or other forms of locks known in the art, for example. The lower height H4 is configured such that the upper deck 12 meets the desired height requirements to fit the marine vessel 10 within the intended boathouse or storage structure in the down position. Likewise, the back rail 70 also meets the NMMA height requirements for a safe railing when the upper portion 71 is rotated atop the lower portion 73 at the upper height H3.

FIGS. 10-11 depict a back rail 70 that is moved between the up position and the down position manually, in contrast to the actuated forward rails 30 previously discussed. However, the back rail 70 could alternatively be provided with a second actuator 80, which may include linear actuation gears, or cables, to automate or mechanically assist in the process of moving the back rail 70 between an up position and a down position. In certain embodiments, the back rail 70 is pivotally coupled to one of the folding side rails 60 with another intermediated rail 50 therebetween (and the stationary side rail 66 becoming a stationary back rail as well) such that one actuator 80 moves the forward rails 30 and back rail 70.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other devices. It is to be expected that various equivalents, alternatives and modifications are possible within the scope of any appended claims.

What is claimed is:

1. A rail system for a marine vessel having an upper deck, the rail system comprising:

a set of forward rails that encloses a portion of the upper deck, the set of forward rails including a front rail and folding side rails, wherein the set of forward rails is pivotable between an up position and a down position; and a plurality of floor hinges that pivotally couple the folding side rails to the upper deck;

wherein the set of forward rails has an up height when in the up position and a down height when in the down position that is lower than the up height.

2. The rail system according to claim 1, wherein the front rail and folding side rails extend vertically from the upper deck when in the up position and are parallel to the upper deck when in the down position.

3. The rail system according to claim 1, wherein the up height is at least 34 inches and the down height is less than 34 inches.

4. The rail system according to claim 1, further comprising intermediate rails and a plurality of side hinges that pivotally couple the intermediate rails between the front rail and the folding rails.

5. The rail system according to claim 4, wherein when the set of forward rails is in the down position the intermediate rails are disposed between the folding side rails and the front rail and the folding side rails are disposed between the intermediate rails and the upper deck.

6. The rail system according to claim 4, wherein each of the intermediate rails has a vertical edge and an angled edge that is angled approximately 45 degrees from the vertical edge, wherein the plurality of side hinges comprises a plurality of front-intermediate hinges that each pivotally couple the front rail to the vertical edge of one of the intermediate rails, and a plurality of intermediate-hinges that each pivotally couple the angled edge of one of the intermediate rails to one of the folding side rails.

7. The rail system according to claim 6, further comprising an actuator coupled between the set of forward rails and the upper deck, wherein the actuator is moveable between a retracted position and an extended position to pivot the set of forward rails between the up position and the down position, respectively.

8. The rail system according to claim 7, wherein the actuator is an electronic linear actuator comprising a movable rod that is receivable within a stationary portion.

9. The rail system according to claim 8, further comprising a controller module and a position encoder, wherein the controller module communicates with the actuator and the position encoder, and wherein the position encoder detects a position of the movable rod relative to stationary portion between an extend limit and a retract limit corresponding to the position of the movable rod when the set of forward rails is in the down position and up position, respectively, and wherein the controller module prevents the actuator from extending and retracting beyond the extend limit and retract limit, respectively.

10. The rail system according to claim 6, further comprising a stationary rail that extends upwardly and non-pivotally from the upper deck.

11. The rail system according to claim 10, further comprising a proximity sensor having a moving portion that moves with the set of forward rails and a fixed portion that remains stationary, wherein the moving portion and the fixed portion are adjacent to each other only when the set of forward rails is in the up position, wherein the marine vessel has a propulsion system that is operable only when the moving portion and the fixed portion of the proximity sensor are adjacent to each other.

12. The rail system according to claim 10, further comprising a lock system having a lock bolt and a lock bolt receiver configured to receive the lock bolt therein, wherein the lock system is coupled between one of the folding side rails and the stationary rail such that when the lock bolt is received within the lock bolt receiver the one of the folding side rails is locked to the stationary rail.

13. The rail system according to claim 6, further comprising a plurality of biasing devices coupled to at least one of the folding side rails, intermediate rails, and front rail, wherein the plurality of biasing devices bias the set of forward rails towards the down position.

14. The rail system according to claim 1, further comprising a back rail having a back up position and a back down position, the back rail comprising a lower portion that extends upwardly and non-pivotally from the upper deck and also an upper portion pivotally coupled to the lower portion, wherein when in the back down position the upper portion rests on the upper deck, and when in the back up position the upper portion rests atop the lower portion.

15. The rail system according to claim 14, further comprising a locking system coupled between the lower portion and the upper portion of the back rail to prevent pivoting therebetween when the back rail is in the back up position.

16. The rail system according to claim 15, wherein the back rail has a back up height of at least 34 inches when in the back up position and a back down height when in the back down position that is lower than the back up height.

17. The rail system according to claim 1, further comprising a front console that is coupled to the front rail, wherein the front console has a rear wall that faces away from the front rail and that rests on the upper deck when the set of forward rails is in the down position.

18. The rail system according to claim 17, further comprising an actuator coupled to the set of forward rails and to the upper deck, wherein the actuator is movable between a retracted position and an extended position to move the set of forward rails between the up position and the down position, respectively, and wherein at least a portion of the actuator is contained within the front console.

19. A rail system for a marine vessel having an upper deck, the rail system comprising:

a set of forward rails that encloses a portion of the upper deck, the set of forward rails including a front rail, folding side rails, and intermediate rails each coupled between the front rail and one of the folding side rails, wherein the set of forward rails is pivotable between an up position and a down position;

a plurality of floor hinges that pivotally couple the folding side rails to the upper deck;

an actuator coupled between the front rail and the upper deck, wherein the actuator is moveable between a retracted position and an extended position to pivot the set of forward rails between the up position and the down position, respectively;

a stationary rail that extends upwardly and non-pivotally from the upper deck; and a lock system having a lock bolt and a lock bolt receiver configured to receive the lock bolt therein, wherein the lock system is coupled between one of the folding side rails and the stationary rail such that when the lock bolt is received within the lock bolt receiver the one of the folding side rails is locked to the stationary rail;

wherein in the up position the folding side rails are perpendicular to the upper deck, and wherein in the down position the intermediate rails are disposed between the folding side rails and the front rail and the folding side rails are disposed between the intermediate rails and the upper deck; and wherein the set of forward rails has an up height when in the up position and a down height when in the down position that is lower than the up height.

20. A rail system for a marine vessel having an upper deck, the rail system comprising:

a set of forward rails that encloses a portion of the upper deck, the set of forward rails including a front rail, folding side rails, and intermediate rails each coupled between the front rail and one of the folding side rails, wherein the set of forward rails is pivotable between an up position and a down position;

a plurality of floor hinges that pivotally couple the folding side rails to the upper deck;

an actuator coupled between the front rail and the upper deck, wherein the actuator is moveable between a retracted position and an extended position to pivot the set of forward rails between the up position and the down position, respectively;

a stationary rail that extends upwardly and non-pivotally from the upper deck; and a lock system having a lock bolt and a lock bolt receiver configured to receive the lock bolt therein, wherein the lock system is coupled between one of the folding side rails and the stationary rail such that when the lock bolt is received within the lock bolt receiver the one of the folding side rails is locked to the stationary rail;

a back rail having a back up position and a back down position, the back rail comprising a lower portion that extends upwardly and non-pivotally from the upper deck and also an upper portion pivotally coupled to the lower portion, wherein when in the back down position the upper portion rests on the upper deck, and when in the back up position the upper portion rests atop the lower portion;

wherein in the up position the folding side rails are perpendicular to the upper deck, and wherein in the down position the intermediate rails are disposed between the folding side rails and the front rail and the folding side rails are disposed between the intermediate rails and the upper deck.

* * * * *